US010594089B2

(12) United States Patent
Durse et al.

(10) Patent No.: US 10,594,089 B2
(45) Date of Patent: Mar. 17, 2020

(54) CONNECTOR WITH RESISTOR-ASSEMBLY

(71) Applicant: Delphi Technologies, LLC, Troy, MI (US)

(72) Inventors: Nicholas A. Durse, Youngstown, OH (US); Thomas S. Huda, Youngstown, OH (US)

(73) Assignee: Delphi Technologies, LLC, Troy, MI (US)

( * ) Notice: Subject to any disclaimer, the term of this patent is extended or adjusted under 35 U.S.C. 154(b) by 2 days.

(21) Appl. No.: 16/021,473

(22) Filed: Jun. 28, 2018

(65) Prior Publication Data

US 2020/0006900 A1 Jan. 2, 2020

(51) Int. Cl.
*H01R 13/66* (2006.01)
*H01R 13/422* (2006.01)
*H01R 13/24* (2006.01)

(52) U.S. Cl.
CPC ..... *H01R 13/6616* (2013.01); *H01R 13/2442* (2013.01); *H01R 13/422* (2013.01)

(58) Field of Classification Search
CPC ..... H01R 13/6658; H01R 2103/00; H01R 13/6616
USPC ..... 439/620.01, 620.03, 620.04
See application file for complete search history.

(56) References Cited

U.S. PATENT DOCUMENTS 4,971,569 A * 11/1990 Gooch ..... H01R 9/0509 200/51.1
5,087,212 A * 2/1992 Hanami ..... H01R 13/6616 362/800
5,094,628 A * 3/1992 Kano ..... H01R 13/7175 362/800
5,118,308 A * 6/1992 Liu ..... H01R 13/6616 338/220
5,267,379 A * 12/1993 Pak ..... H01L 23/49589 257/666
7,140,920 B1 * 11/2006 Lin ..... H01R 13/6641 439/620.3
7,344,414 B2 * 3/2008 Kuo ..... H01R 13/641 439/620.01

(Continued)

*Primary Examiner* — Thanh Tam T Le
(74) *Attorney, Agent, or Firm* — Robert J. Myers

(57) ABSTRACT

A connector-assembly includes a housing, a terminal-position-assurance device, and a resistor-assembly. The housing includes a plurality of electrical-terminals. The terminal-position-assurance device is configured to retain the plurality of electrical-terminals within the housing. The resistor-assembly is disposed within the terminal-position-assurance device and includes a first-spring-terminal, a second-spring-terminal, and a resistor disposed between the first-spring-terminal and the second-spring-terminal. The first-spring-terminal and the second-spring-terminal are in separate electrical-communication with at least one of the plurality of electrical-terminals. The resistor has connection-leads disposed within slots formed in both the first-spring-terminal and the second-spring-terminal, and is disposed within channels formed in the terminal-position-assurance device. The first-spring-terminal, the second-spring-terminal, and the terminal-position-assurance device are in compressive contact with a portion of the connection-leads.

16 Claims, 5 Drawing Sheets

(56) References Cited

U.S. PATENT DOCUMENTS

| | | | | |
|---|---|---|---|---|
| 7,772,946 | B2 * | 8/2010 | Oh | H02K 5/225 335/219 |
| 7,823,280 | B2 * | 11/2010 | Chung | F16D 27/00 264/37.33 |
| 7,892,021 | B2 * | 2/2011 | Clem | H01R 12/675 439/386 |
| 9,505,313 | B2 * | 11/2016 | Shimizu | H01R 13/4367 |
| 9,543,713 | B2 * | 1/2017 | Shimizu | H01R 13/6616 |
| 10,148,243 | B2 * | 12/2018 | Montena | H01R 13/6616 |

* cited by examiner

CONNECTOR WITH RESISTOR-ASSEMBLY

TECHNICAL FIELD OF INVENTION

This disclosure generally relates to an electrical connector, and more particularly relates to an electrical connector with a resistor-assembly.

BRIEF DESCRIPTION OF DRAWINGS

The present invention will now be described, by way of example with reference to the accompanying drawings, in which.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
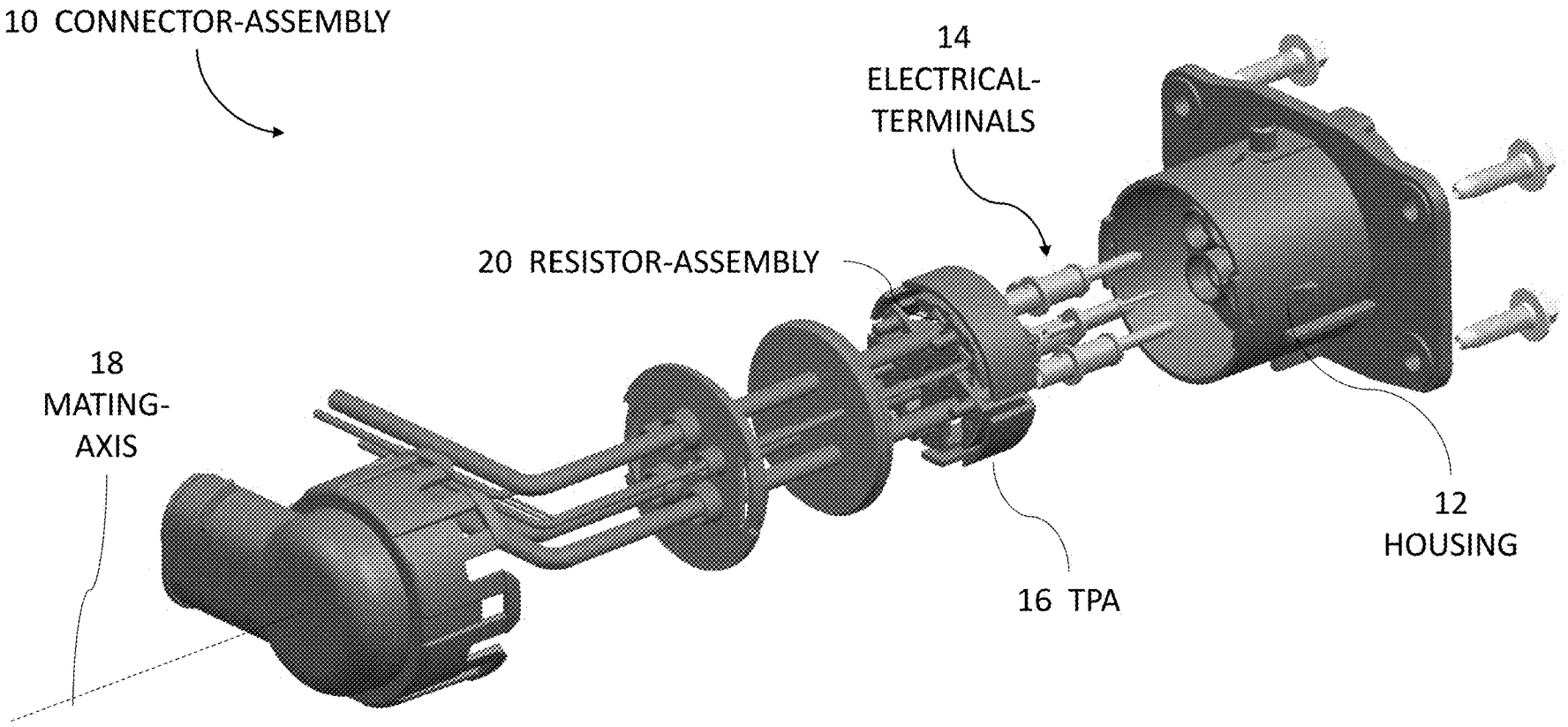
FIG. 1 is an exploded perspective view of a connector assembly in accordance with one embodiment.

FIG. 1 is an exploded view illustrating a connector-assembly 10, hereafter referred to as the assembly 10. The assembly 10 includes a housing 12 having a plurality of electrical-terminals 14. The housing 12 is formed of a polymeric dielectric material. The polymeric dielectric material may be any polymeric dielectric material capable of electrically isolating portions of the plurality of electrical-terminals 14, and is preferably a polyamide (NYLON) material. The plurality of electrical-terminals 14 are configured to mate with corresponding electrical-terminals of a mating-connector (not shown). The plurality of electrical-terminals 14 are formed of an electrically conductive material, such as a copper-based alloy that may also include a coating of another conductive material (e.g. a tin-based or silver-based coating). The plurality of electrical-terminals 14 are configured to be attached to wire cables (not specifically shown) that may be a component of a wiring-harness of a vehicle.

The assembly 10 also includes a terminal-position-assurance device 16 (TPA 16) configured to retain the plurality of electrical-terminals 14 within the housing 12.

The TPA 16 is formed of a polymeric dielectric material. The polymeric dielectric material may be any polymeric dielectric material capable of electrically isolating portions of the plurality of electrical-terminals 14, and is preferably a polyamide (NYLON) material. The TPA 16 inhibits a removal of the plurality of electrical-terminals 14 from the housing 12 when an external-force is applied to the wire cables. The TPA 16 is inserted into the housing 12 along a mating-axis 18 and is retained within the housing 12 by other components of the assembly 10 (not specifically shown), which may include seals, retainers, and a connector-cap.

Figure 2:
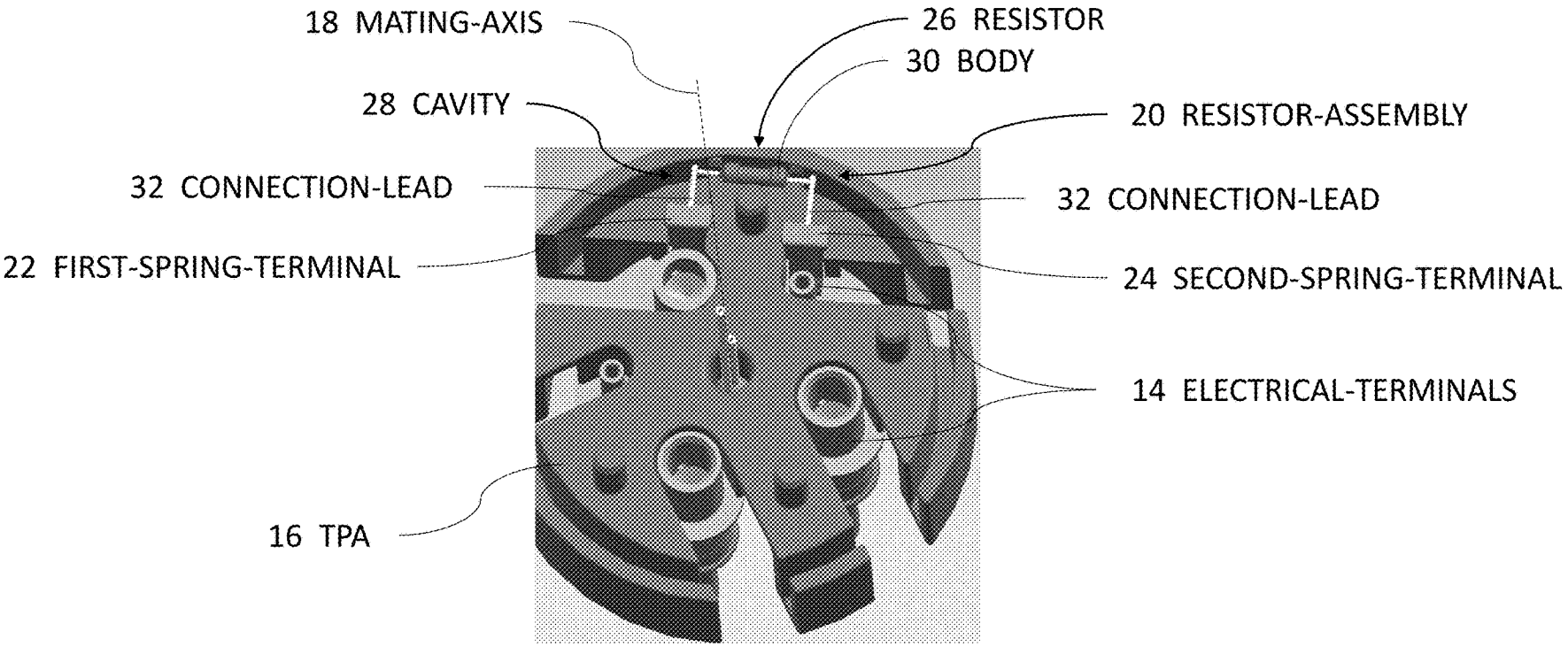
FIG. 2 is a perspective end-view of a terminal-position-assurance device, a resistor-assembly, and a plurality of electrical-terminals isolated from the assembly of FIG. 1. in accordance with one embodiment.

FIG. 2 is a perspective end-view of the TPA 16, a resistor-assembly 20, and the plurality of electrical-terminals 14 isolated from the assembly 10 of FIG. 1. The assembly 10 also includes the resistor-assembly 20 disposed within the TPA 16. The resistor-assembly 20 includes a first-spring-terminal 22, a second-spring-terminal 24, and a resistor 26 disposed between the first-spring-terminal 22 and the second-spring-terminal 24. The first-spring-terminal 22 and the second-spring-terminal 24 are in separate electrical-communication with at least one of the plurality of electrical-terminals 14. The first-spring-terminal 22 and the second-spring-terminal 24 are formed of an electrically conductive material, such as a copper-based alloy that may also include a coating of another conductive material (e.g. a tin-based or silver-based coating). The TPA 16 defines a cavity 28 and a body 30 of the resistor 26 is disposed within the cavity 28. The cavity 28 securely retains the resistor 26 and inhibits movement of the resistor 26 that may be caused by vibrations and shock-loads experienced during the operation of the vehicle.

Figure 3:
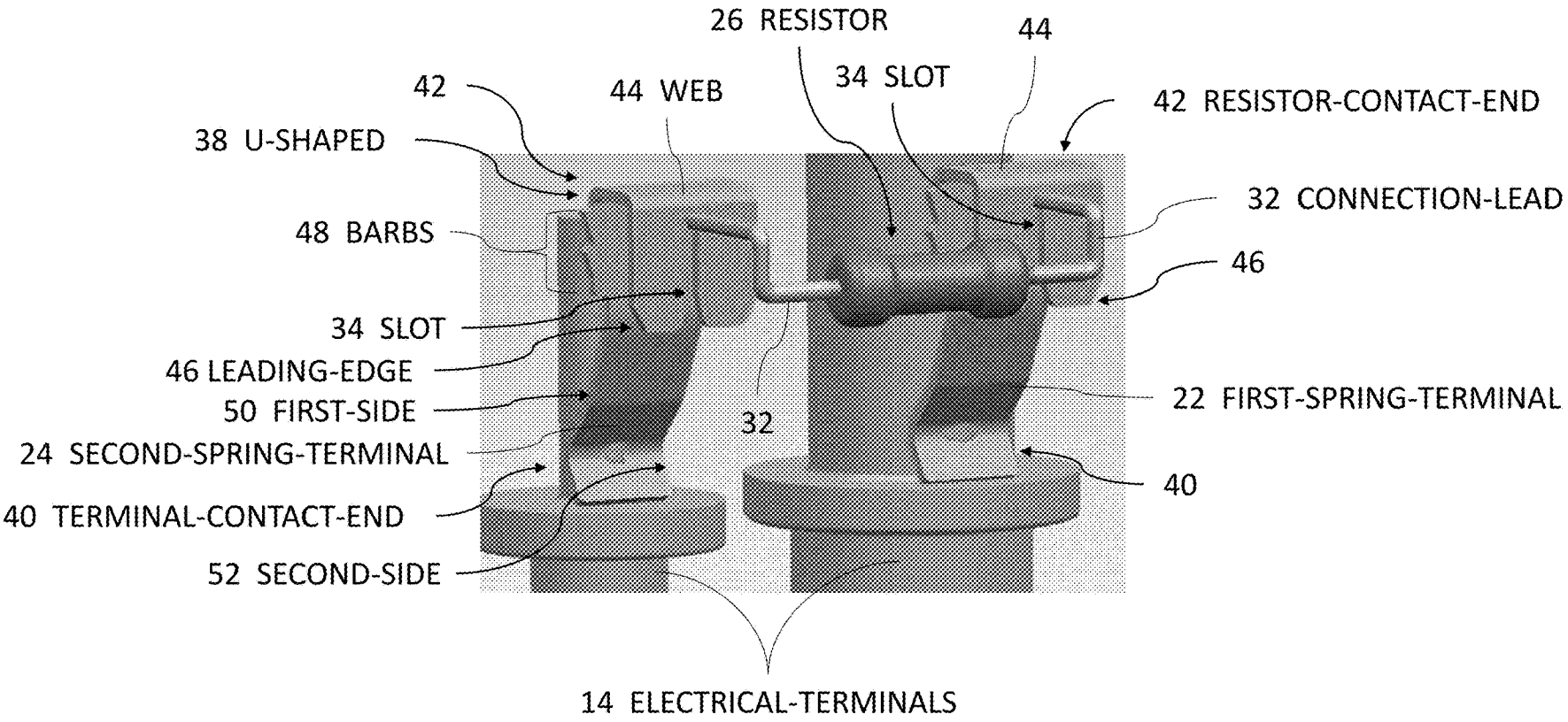
FIG. 3 is a perspective view illustrating the resistor-assembly and two of the plurality of electrical-terminals 14 isolated from the assembly of FIG. 1. in accordance with one embodiment.

FIG. 3 illustrates the resistor-assembly 20 and two of the plurality of electrical-terminals 14 isolated from the assembly 10 of FIG. 1. The resistor 26 has connection-leads 32 disposed within slots 34 formed in both the first-spring-terminal 22 and the second-spring-terminal 24. In the example illustrated in FIG. 3, the connection-leads 32 are press-fit into the slots 34. In another embodiment, connection-leads 32 are also metallurgically bonded (e.g. soldered or welded, etc.) to the first-spring-terminal 22 and the second-spring-terminal 24. In another embodiment, the connection-leads 32 are also crimped to the first-spring-terminal 22 and the second-spring-terminal 24.

In the examples illustrated in FIGS. 2-3, the first-spring-terminal 22 and the second-spring-terminal 24 are generally U-shaped 38, having a terminal-contact-end 40 and a resistor-contact-end 42 connected by a web 44. The terminal-contact-end 40 is opposite to, and generally parallel to, the resistor-contact-end 42. The slots 34 extend from the web 44 and terminate at a leading-edge 46 of the resistor-contact-end 42 and are characterized as open-ended slots 34. The terminal-contact-end 40 includes barbs 48 on a first-side 50 and a second-side 52 proximate the web 44. The barbs 48 engage walls 54 of the TPA 16, as illustrated in FIG. 5.

Figure 4:
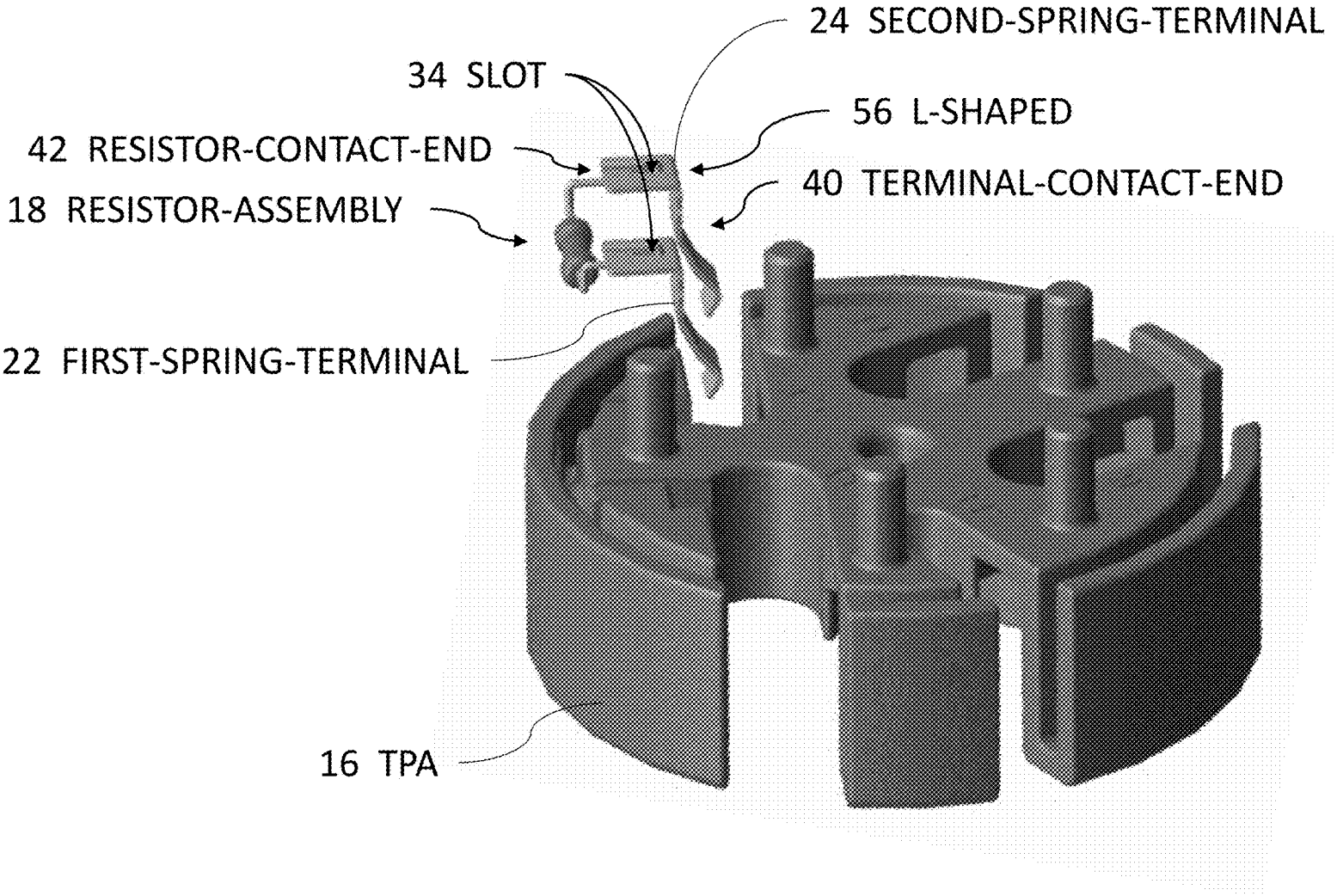
FIG. 4 is a perspective view of another resistor-assembly and terminal-position-assurance device the in accordance with one embodiment.

In another embodiment illustrated in FIG. 4, the first-spring-terminal 22 and the second-spring-terminal 24 are generally L-shaped 56 having the terminal-contact-end 40 and the resistor-contact-end 42 generally perpendicular to one another. The slots 34 extend from the terminal-contact-end 40 along a portion of the resistor-contact-end 42 and are characterized as closed-ended slots 34. The connection-leads 32 of the resistor 26 pass through the slots 34 and are folded 180-degrees back on themselves capturing the first-spring-terminal 22 and the second-spring-terminal 24. In the example illustrated in FIG. 4, the connection-leads 32 are press-fit into the slots 34. In another embodiment, connection-leads 32 are metallurgically bonded (e.g. soldered, welded, etc.) to the L-shaped 56 first-spring-terminal 22 and the L-shaped 56 second-spring-terminal 24. In another embodiment, the connection-leads 32 are also crimped to the L-shaped 56 first-spring-terminal 22 and the L-shaped 56 second-spring-terminal 24.

Figure 5:
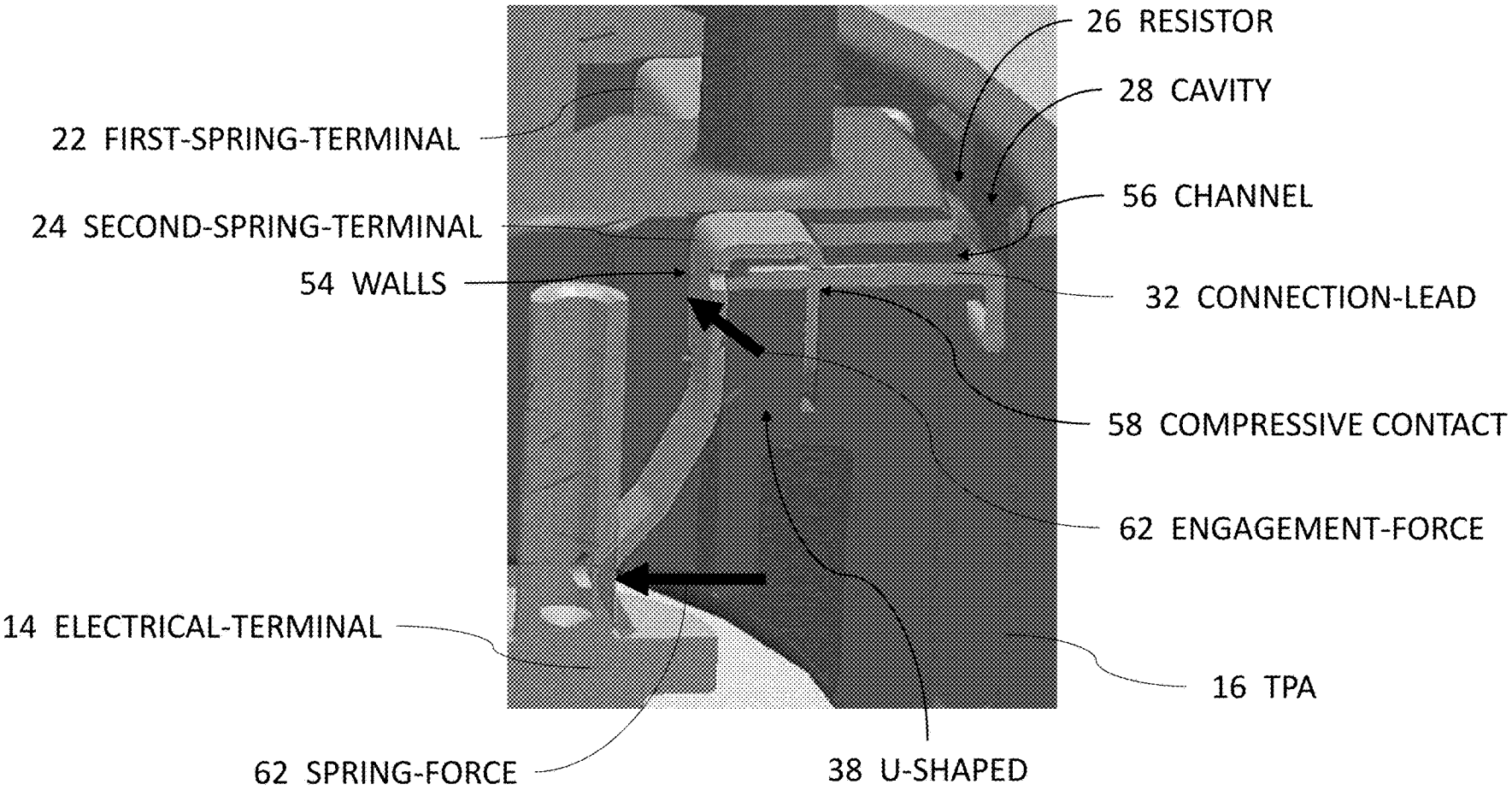
FIG. 5 is a section view of the assembly of FIG. 2 in accordance with one embodiment.

FIG. 5 is a section-view of FIG. 2 illustrating the resistor-assembly 20 in contact with the plurality of electrical-terminals 14 and the TPA 16. The connection-leads 32 of the resistor 26 are disposed within channels 58 formed in the TPA 16. That is, the connection-leads 32 lay in grooves molded into a top-surface of the TPA 16 that are orthogonal to the mating-axis 18 of the assembly 10. The U-shaped 38 first-spring-terminal 22, the U-shaped 38 second-spring-terminal 24, and the TPA 16 are in compressive contact 60 with a portion of the connection-leads 32. The compressive contact 60 is maintained by the barbs 48 engaging the walls 54 of the TPA 16, as described above. A spring-force 62 of the first-spring-terminal 22 and the second-spring-terminal 24 against the plurality of electrical-terminals 14 is greater than 5 Newtons. The inventors have discovered that this magnitude of the spring-force 62 provides a balance between ergonomics for an assembler and electrical continuity between the conductive components. An engagement-force 64 of the first-spring-terminal 22 and the second-spring-terminal 24 against the TPA 16 is greater than 20 Newtons. The inventors have discovered that this magnitude of the engagement-force 64 inhibits an unintentional removal of the resistor-assembly 20. While FIG. 5 illustrates the U-shaped 38 first-spring-terminal 22 and the U-shaped 38 second-spring-terminal 24, it will be appreciated that the L-shaped 56 first-spring-terminal 22, the L-shaped 56 second-spring-terminal 24 may also be used in the assembly 10.

Accordingly, a connector-assembly 10 is provided. The connector-assembly 10 is an improvement over prior art connector-assemblies because the connector-assembly 10 includes the resistor-assembly 20 that is nested in the TPA 16.

While this invention has been described in terms of the preferred embodiments thereof, it is not intended to be so limited, but rather only to the extent set forth in the claims that follow. "One or more" includes a function being performed by one element, a function being performed by more than one element, e.g., in a distributed fashion, several functions being performed by one element, several functions being performed by several elements, or any combination of the above. It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact. The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context. Directional terms such as top, bottom, upper, lower, left, right, front, rear, etc. do not denote any particular orientation, but rather these directional terms are used to distinguish one element from another and establish a relationship between the various elements.

We claim:

1. A connector-assembly, comprising:

a housing including a plurality of electrical-terminals;

a terminal-position-assurance device configured to retain the plurality of electrical-terminals within the housing; and a resistor-assembly disposed within the terminal-position-assurance device;

the resistor-assembly including a first-spring-terminal, a second-spring-terminal, and a resistor disposed therebetween;

the first-spring-terminal and the second-spring-terminal in separate electrical-communication with at least one of the plurality of electrical-terminals;

the resistor having connection-leads disposed within slots formed in both the first-spring-terminal and the second-spring-terminal and disposed within channels formed in the terminal-position-assurance device;

wherein the first-spring-terminal and the second-spring-terminal each has a terminal-contact-end and a resistor-contact-end connected by a web;

wherein the terminal-contact-end is opposite and generally parallel to the resistor-contact-end;

wherein the slots each extends from the web and terminate at a leading-edge of the resistor-contact-end and characterized as an open ended; and wherein the first-spring-terminal, the second-spring-terminal, and the terminal-position-assurance device are in compressive contact with a portion of the connection-leads.

2. The connector-assembly in accordance with claim 1, wherein the terminal-position-assurance device defines a cavity and a body of the resistor is disposed within the cavity.

3. The connector-assembly in accordance with claim 1, wherein the first-spring-terminal and the second-spring-terminal are generally U-shaped.

4. The connector-assembly in accordance with claim 3, wherein the terminal-contact-end includes barbs on a first-side and a second-side proximate the web, the barbs engaging walls of the terminal-position-assurance device.

5. The connector-assembly in accordance with claim 1, wherein the first-spring-terminal and the second-spring-terminal are generally L-shaped.

6. The connector-assembly in accordance with claim 5, wherein the terminal-contact-end includes barbs on a first-side and a second-side proximate the resistor-contact-end, the barbs engaging walls of the terminal-position-assurance device.

7. The connector-assembly in accordance with claim 1, wherein a spring-force of the first-spring-terminal and the second-spring-terminal against the plurality of electrical-terminals is greater than 5 Newtons.

8. The connector-assembly in accordance with claim 1, wherein an engagement-force of the first-spring-terminal and the second-spring-terminal against the terminal-position-assurance device is greater than 20 Newtons.

9. The connector-assembly in accordance with claim 1, wherein the connection-leads of the resistor are metallurgically bonded to the first-spring-terminal and the second-spring-terminal.

10. The connector-assembly in accordance with claim 1, wherein the terminal-position-assurance device is retained within the housing by a component selected from the list consisting of a seal, a retainer, and a connector-cap.

11. The connector-assembly in accordance with claim 1, wherein the cavity is configured to securely retain the resistor and inhibit movement of the resistor caused by vibrations and shock-loads.

12. The connector-assembly in accordance with claim 1, wherein the terminal-position-assurance device is formed from a dielectric polymeric material.

13. The connector-assembly in accordance with claim 12, wherein the terminal-position-assurance device is formed from a polyamide material.

14. The connector-assembly in accordance with claim 1, wherein the connection-leads are press-fit into the slots.

15. The connector-assembly in accordance with claim 1, wherein the connection-leads pass through the slots and are folded 180-degrees back on themselves, thereby capturing the first-spring-terminal and the second-spring-terminal.

16. The connector-assembly in accordance with claim 1, wherein each resistor-contact-end defines a single slot.

* * * * *